US011547919B2

(12) United States Patent
Go

(10) Patent No.: US 11,547,919 B2
(45) Date of Patent: Jan. 10, 2023

(54) COMBINED GOLF BALL AND TURF FOR PUTTING PRACTICE

(71) Applicant: Kenneth Go, Round Lake Heights, IL (US)

(72) Inventor: Kenneth Go, Round Lake Heights, IL (US)

( * ) Notice: Subject to any disclaimer, the term of this patent is extended or adjusted under 35 U.S.C. 154(b) by 0 days.

(21) Appl. No.: 16/208,527

(22) Filed: Dec. 3, 2018

(65) Prior Publication Data

US 2019/0275401 A1 Sep. 12, 2019

Related U.S. Application Data

(60) Provisional application No. 62/639,484, filed on Mar. 6, 2018.

(51) Int. Cl.

| | |
|---|---|
| ***A63B 37/06*** | (2006.01) |
| ***A63B 69/36*** | (2006.01) |
| ***E01C 13/08*** | (2006.01) |
| ***A63B 37/00*** | (2006.01) |

(52) U.S. Cl.

CPC ..... *A63B 69/3661* (2013.01); *A63B 37/0023* (2013.01); *A63B 69/3676* (2013.01); *E01C 13/08* (2013.01)

(58) Field of Classification Search

CPC .. A63B 39/06; A63B 37/0005; A63B 37/0023
USPC ..... 473/378
See application file for complete search history.

(56) References Cited

U.S. PATENT DOCUMENTS

| | | | | | |
|---|---|---|---|---|---|
| 4,756,529 | A * | 7/1988 | Stillinger | A63H 9/00 | 473/614 |
| D306,469 | S * | 3/1990 | Norman | D21/713 | |
| 4,953,870 | A * | 9/1990 | Norman | A63F 3/00214 | 273/241 |
| 4,991,841 | A * | 2/1991 | Paranto | A63B 43/00 | 446/490 |
| 5,211,788 | A * | 5/1993 | Song | A63B 39/06 | 156/148 |
| D714,890 | S * | 10/2014 | Boiman | D21/709 | |
| D782,360 | S * | 3/2017 | Kaczmarski | D11/117 | |
| 2003/0176228 | A1* | 9/2003 | Santa Cruz | A63B 43/005 | 473/235 |
| 2003/0203770 | A1* | 10/2003 | Dewanjee | A63B 37/0003 | 473/356 |
| 2006/0288600 | A1* | 12/2006 | Taylor | D06F 58/203 | 34/60 |
| 2017/0157487 | A1* | 6/2017 | Faucette | A63B 69/3617 | |
| 2017/0296881 | A1* | 10/2017 | Hebert | A63B 37/0094 | |

OTHER PUBLICATIONS

Grassy Golf Ball Image with visible golfball dimples (Year: 2017).*
Green Grassy Ball Image (Year: 2011).*

* cited by examiner

*Primary Examiner* — Raeann Gorden
(74) *Attorney, Agent, or Firm* — Scherrer Patent & Trademark Law, P.C.; Stephen T. Scherrer; Monique A. Moreault

(57) ABSTRACT

A device including a center core, an outer layer that is configured to encase the center core, an artificial grass implement that is into engagement with the outer layer and that is configured to simulate a grass turf, and wherein the device is configured to be operable for practicing golf putting strategies or techniques.

22 Claims, 4 Drawing Sheets

COMBINED GOLF BALL AND TURF FOR PUTTING PRACTICE

CROSS-REFERENCE TO RELATED APPLICATIONS

The present Utility patent application claims priority benefit of the U.S. provisional application for patent Ser. No. 62/639,484 entitled "Golf Ball with Simulated Grass Blades", filed on 6 Mar. 2018, under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to golf balls. More particularly, certain embodiments of the invention relates to golf balls for practicing.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, an aspect of the prior art generally useful to be aware of is that there are several ways a person may practice golfing while away from a golf course and indoors. A person may practice on wood floors, carpets or rugs, but that doesn't help a user get used to how it feels to golf on actual grass. Another way to practice is to purchase a rug/carpet of artificial grass that may resemble golfing on actual grass. Often though these are meant to just look like grass, not resemble the feeling of golfing on actual grass. Furthermore, these are less likely to resemble golfing on specific parts of a golf course such as the important green part of a golf course. Furthermore still, these artificial green spaces are often very large and may require complex installations.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
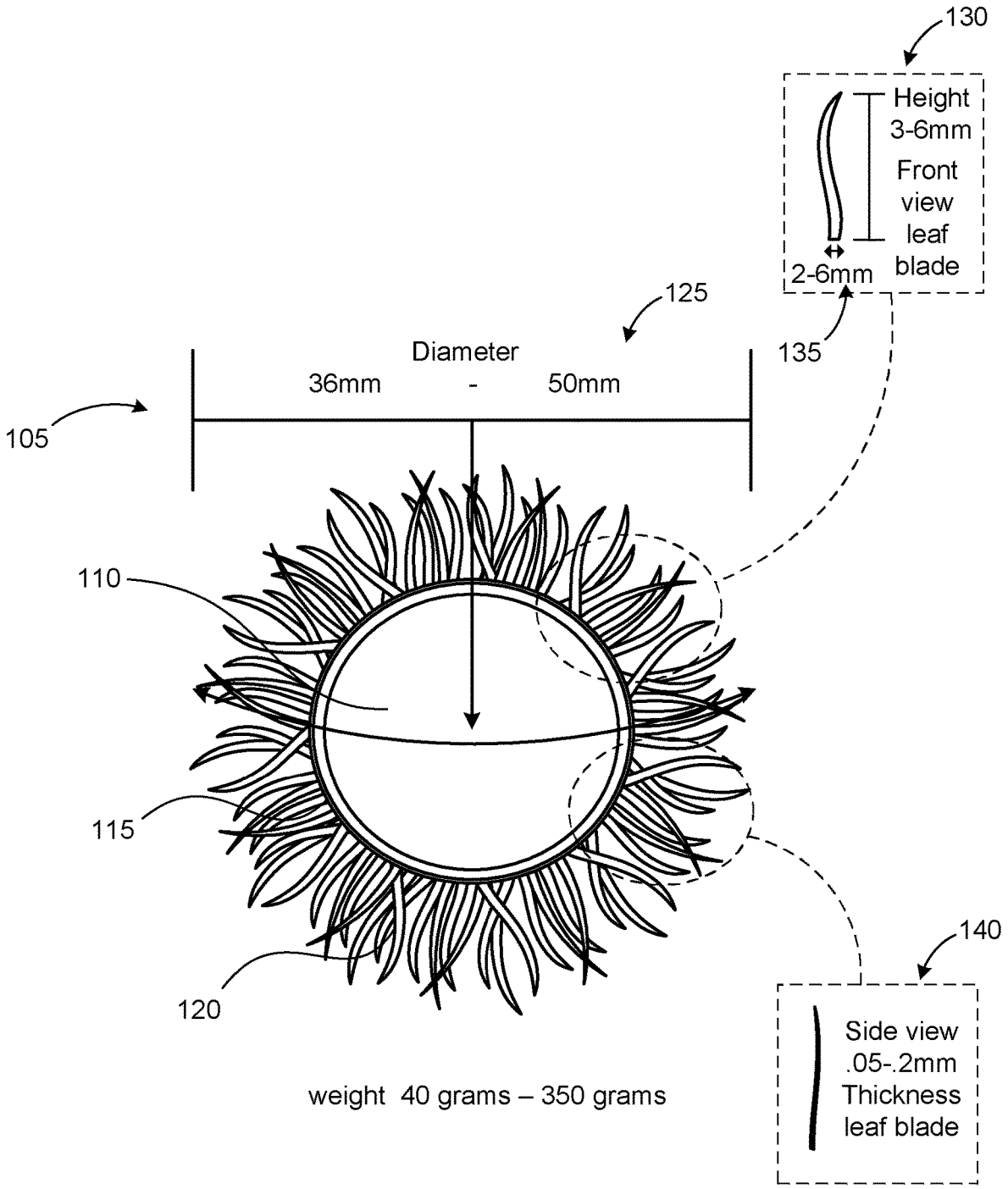
FIG. 1 illustrates an exemplary golf ball structure, in accordance with an embodiment of the invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See *Energy Absorption Sys., Inc.* v. *Roadway Safety Servs., Inc.*, Civ. App. 96-1264, slip op. at 10 (Fed. Cir. Jul. 3, 1997) (unpublished) *Hybridtech* v. *Monoclonal Antibodies, Inc.,* 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See *Seattle Box Co.* v. *Industrial Crating & Packing, Inc.,* 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. *Deering Precision Instruments, L.L.C.* v. *Vector Distribution Sys., Inc.,* 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See *Dana Corp.* v. *American Axle & Manufacturing, Inc.*, Civ. App. 04-1116, 2004 U.S. App. LEXIS 18265, *13-14 (Fed. Cir. Aug. 27, 2004) (unpublished). The term "substantially" is commonly used by claim drafters to indicate approximation. See *Cordis Corp.* v. *Medtronic AVE Inc.,* 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also *Deering Precision Instruments, LLC* v. *Vector Distribution Sys., Inc.,* 347 F.3d 1314, 1322 (Fed. Cir. 2003); *Epcon Gas Sys., Inc.* v. *Bauer Compressors, Inc.,* 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, *Liquid Dynamics Corp.* v. *Vaughan Co.,* 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In *Cordis Corp.* v. *Medtronic AVE, Inc.,* 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In *Anchor Wall Systems* v. *Rockwood Retaining Walls, Inc.,* 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see *Deering Precision Instruments, L.L.C.* v. *Vector Distrib. Sys., Inc.,* 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., *Epcon Gas Sys., Inc.* v. *Bauer Compressors, Inc.,* 279 F.3d 1022 (Fed. Cir. 2002) (construing the terms "substantially constant" and "substantially below"); *Zodiac Pool Care, Inc.* v. *Hoffinger Indus., Inc.,* 206 F.3d 1408 (Fed. Cir. 2000) (construing the term "substantially inward"); *York Prods., Inc.* v. *Cent. Tractor Farm & Family Ctr.,* 99 F.3d 1568 (Fed. Cir. 1996) (construing the term "substantially the entire height thereof"); *Tex. Instruments Inc.* v. *Cypress Semiconductor Corp.,* 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see *AK Steel Corp.* v. *Sollac,* 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by *Pall Corp.* v. *Micron Separations, Inc.,* 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see *Verve LLC* v. *Crane Cams Inc.,* 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In *Andrew Corp.* v. *Gabriel Elecs. Inc.,* 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in *Ecolab Inc.* v. *Envirochem, Inc.,* 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see *Ecolab Inc.* v. *Envirochem Inc.,* 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter.", e.g., see *Pall Corp.* v. *Micron Seps.,* 66 F.3d 1211, 1217, 36 USPQ2d 1225, 1229 (Fed. Cir. 1995); see, e.g., *Andrew Corp.* v. *Gabriel Elecs. Inc.,* 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of, or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology

The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of" should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide an improved golf ball with grass blades around the golf ball. A golf ball may have blades of synthetic, simulated and/or artificial grass around the golf ball in order to give a user a feel of golfing on actual grass. The simulated/artificial grass around the golf ball may include but not limited to, simulated/artificial Bermuda grass, simulated/artificial perennial ryegrass, simulated/artificial Zoysia, etc. For example, among time-tested and well-known golf course grasses, the Bermuda grass is used in warm-weather golf locations. The Bentgrass is a member of the poa family and may be considered the best grass for golf course greens in the South. It has a fine texture and may stand up to constant and low mowing. Perennial ryegrass may be found in nearly any cool-summer region. Zoysia may be used in a wide range of climates, with the exception of desert or cold western locations. The simulated/artificial grass around the golf ball may allow a user to more effectively mimic/simulate real grass while practicing golfing indoors. This may also make easier to practice since you may no longer need a large space to setup a practice green area. The simulated/artificial grass around the golf ball may allow a user to practice putting strategies or techniques on any surface without grass but with the same effects as if playing on a green part of a golf course. A golf ball may come in a type resembling a green part of a golf course or any variation in size or weight or synthetic grass blade material layout in order to mimic golfing in various types of grass or conditions. Furthermore, a golf ball with simulated/artificial grass blades may be made using materials including but not limited to a core, an attachment mechanism, and an outer cover embedded with grass blades. A two-piece putting golf ball formed by, but not limited to, a generally spherical central core surrounded with an outer cover embedded with simulated grass blades. Or a three-piece putting ball having, but not limited to, a central core, a support covering the core, an outer cover embedded with grass blades, and an attachment mechanism for attaching the central core to the outer cover. A golf ball with simulated/artificial grass blades may be an improvement over all prior art in that this allows practicing for grass play while indoors. A golf ball with simulated/artificial grass blades may be able to recreate a golfing on grass experience even on smooth floors such as but not limited to wooden or tile floors. Varying materials and weight may help control the resulting inertia or momentum or resistance for a golf ball with grass blades. A golf ball with simulated/artificial grass blades may help simulate an important part of a golf course, the green, or any other area or an area under conditions such as rain or wind or on an incline. The manufacturing process may vary in the composition and materials used, based on whether the golf ball is made for distance, speed and/or control. The golf ball may be played on real grass surfaces, simulated/artificial grass surfaces, and/or non-grass surfaces. Non-grassy surfaces may include but not limited to, indoor structures or outdoor structures such as wood surfaces, cement surfaces, carpeted floors, asphalt surfaces, etc.

A golf ball may be produced by having simulated/artificial grass leaf blades inserted on an outer surface of a golf ball. In one embodiment, a two-piece ball may include a proximately spherical solid or hollow rubber, molded rubber, or synthetic rubber core enclosed/surrounded with a durable cover having simulated and/or artificial grass leaf blades to produce a practice putting golf ball. In another embodiment, a three-piece ball may include a proximately spherical solid or hollow rubber, molded rubber, or synthetic rubber core enclosed/surrounded with a durable cover having simulated and/or artificial grass leaf blades to produce a practice putting golf ball. It is contemplated that a multiplicity of suitable methods may be used to produce the ball including, but not limited to, inserting leaf blades in to the ball itself, cutting grooves in the shape of grass blades into a golf ball, or creating a sleeve into which the leaf blades may be inserted that may then be wrapped around the ball. Such a sleeve may be configured to be permanently attached to the ball or removable. An alternative may be to wrap a ball of appropriate weight and size in a sheet of premade artificial turf with leaf blades of appropriate density, length, height, and/or width. The simulated and/or artificial turf around the golf ball may include but not limited to, simulated/artificial Bermuda grass turf, simulated/artificial perennial ryegrass turf, simulated/artificial Zoysia grass turf, etc. In an alternative to wrapping a ball in grass using a golf ball, a ball may alternatively be a soccer ball or a tennis ball playing on clay or any sport's ball rolling on any type of land. Furthermore, a golf ball may have simulated/artificial grass blades at varying degrees of density including height, length and/or width. combinations of densities, lengths, heights, and widths of the leaf blades and the size and weight of the ball may interact to affect the trajectory and velocity of the ball. For example, without limitation, longer and dense leaf blades typically result in an effect as if the golf ball was in the "Rough" part of the course. Decreasing the density of the leaf blades may replicate dryer grass conditions while increasing the density of the leaf blades may replicate wet grass conditions. In another non-limiting example, shorter and dense leaf blades typically result in an effect as if the golf ball is in the "Green" part of the course, and to replicate wet or dry conditions higher density leaf blades or lower density leaf blades may be used. In short, the density of the leaf blades typically affects how wet or dry the conditions on the course appear while the length of the leaf blades typically affects which part of the golf course is being replicated. The dimensions of the leaves themselves typically affect what type of grass is being replicated. The size and weight of the ball may affect distance control and perceived slopes by affecting the speed of the ball. For example, without limitation, a heavier ball typically results in a slower shot with greater tolerance for error to the aim compared to a lighter ball applied with the same force, which will typically travel faster and further but with less tolerance for error in the aim. Using a heavier ball may replicate putting uphill as more force may be required to make the shot, and conversely a lighter ball may replicate putting downhill. In short the size of the ball may affect aim/direction or accuracy of the user while the weight of the ball typically affects distance or the applied force of the user. Moreover, a golf ball may have different colors to simulate grass turfs that may reflect the different seasons of the year. For example, a golf ball may be enclosed/surrounded with green, yellow, brown, red, or orange simulated/artificial grass blades. The color of the simulated/artificial grass blades can also be used to contrast the surface for greater visibility, which may provide an added benefit for practice as the user can visualize error and make corrections with each putt. In some embodiments, luminous or glow in the dark colors can be added for low light conditions.

FIG. 1 illustrates an exemplary golf ball structure, in accordance with an embodiment of the invention. FIG. 1 includes exemplary dimensions for a golf ball 105 that is configured to be operable for giving a user a feeling of golfing on actual grass. The golf ball 105 having a center portion 110 may be made of, but is not limited to, common professional golf ball materials, or based on common golf ball materials such as but not limited to natural or synthetic polymers, rubber and/or inorganic fibers including metal, glass fibers, etc. In one embodiment, the diameter 125 of the center portion 110 of the golf ball may include but not limited to approximately 36 mm to 50 mm. Furthermore, a golf ball 105 may be made completely of alternative materials, possibly to mimic conditions besides the green part of a golf course. A golf ball-based center may have an outer layer 115 with artificial/simulated grass blades 120. These artificial/simulated grass blades 120 may vary in length or density or materials depending on what a user may want to practice for. In some embodiments, an artificial/simulated grass blade may have dimensions of, but not limited to, approximately 3 mm-6 mm in height 130, approximately 0.2-0.6 mm in width 135, and approximately 0.05 mm-0.2 mm in thickness 140. The simulated/artificial grass around the golf ball may include but not limited to, simulated/artificial Bermuda grass, simulated/artificial perennial ryegrass, simulated/artificial Zoysia, etc.

Figure 2A:
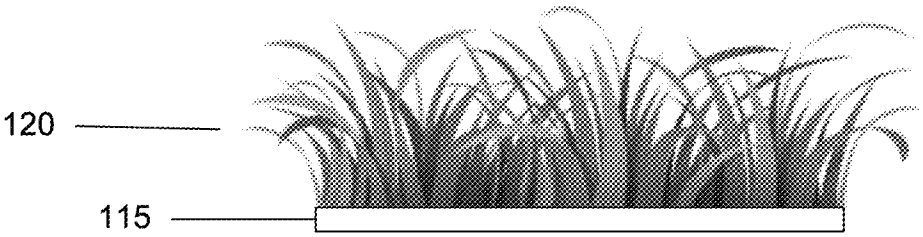
FIG. 2A, FIG. 2B and FIG. 2C illustrates exemplary artificial/simulated grass structures 120, in accordance with an embodiment of the invention.
Figure 2B:
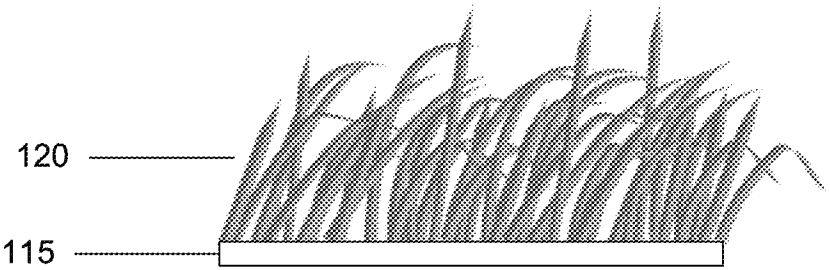
Figure 2C:
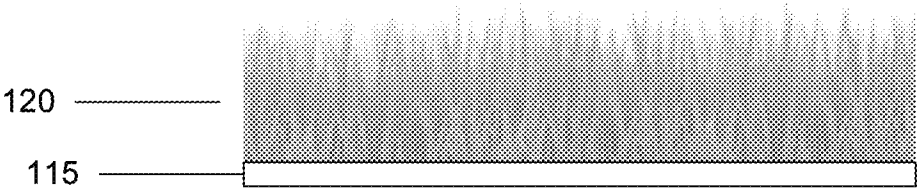

FIGS. 2A, 2B and 2C illustrates various exemplary artificial/simulated grass structures 120, in accordance with an embodiment of the invention. In the present embodiment, FIG. 2A shows a simulated and/or artificial wide grass leaves 120 held together on an outer layer/cover 115. FIG. 2B shows a simulated and/or artificial medium width grass leaves 120 held together on an outer layer 115. FIG. 2C shows a simulated and/or artificial thin leafed grass leaves 120 held together on an outer layer 115. The simulated and/or artificial grass leaves 120 may be held together by embedding, planting, gluing, bonding, molding and/or stitching into the outer cover 115. The simulated/artificial turf 120 may include but not limited to, simulated/artificial Bermuda grass turf, simulated/artificial perennial ryegrass turf, simulated/artificial Zoysia grass turf, etc. In additional embodiments, the simulated/artificial turf 120 (artificial grass leaves 120 held together by embedding, planting, gluing, bonding, molding and/or stitching into the outer cover 115) may include different colors to reflect the different seasons of the year. For example, a golf ball may be enclosed, encircled or surrounded with green artificial grass blades to simulate spring grass, yellow or brown artificial grass blades to simulate summer grass, red or orange artificial grass blades to simulate fall grass, etc.

Figure 3A:
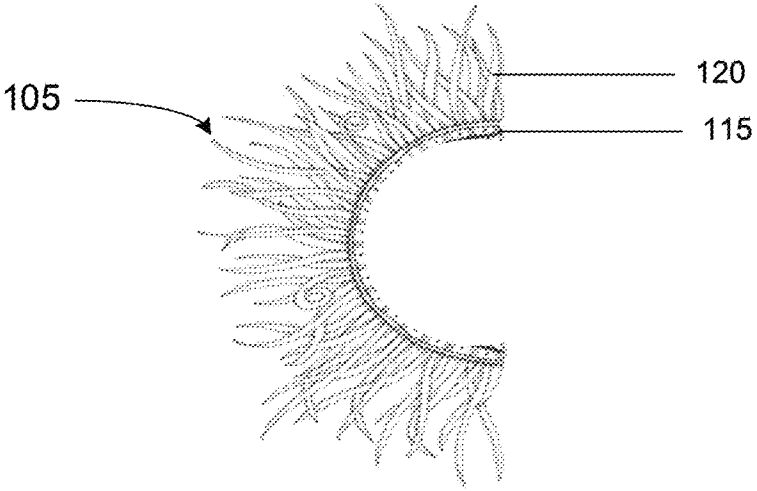
FIG. 3A and FIG. 3B illustrates an exemplary golf ball structure with an artificial and/or simulated grass blades 120, in accordance with an embodiment of the invention.
Figure 3B:
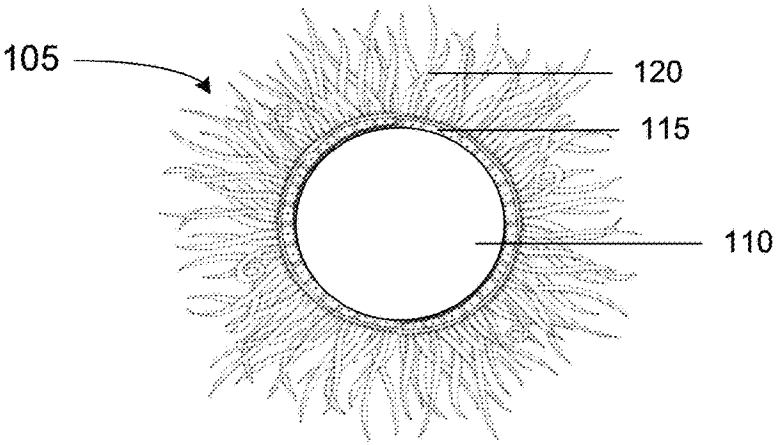

FIG. 3A and FIG. 3B illustrates an exemplary golf ball structure with artificial/simulated grass blades 120, in accordance with an embodiment of the invention. In one embodiment of the present invention, FIG. 3A shows an outer cover 115 for partially covering the central core 110, the artificial/simulated grass leaf blades 120 embedded, planted, glued, bonded, molded and/or stitched into the outer cover 115. The simulated/artificial turf 120 may include but not limited to, simulated/artificial Bermuda grass, simulated/artificial perennial ryegrass, simulated/artificial Zoysia, etc. In the embodiment of the present invention, FIG. 3B shows a generally spherical central core 110, an outer cover 115 for enclosing the central core, artificial/simulated grass leaf blades 120 embedded, planted, glued, bonded, molded and/or stitched into the outer cover 115 to produce a putting golf ball 105 The outer cover 115 may comprise of two (2) or more parts glued or stitched together to enclose the central core. Alternatively, the outer cover 115 may comprise of a single piece enclosing the central core. Furthermore, a golf ball 105 may be made completely of alternative materials, possibly to mimic conditions besides the green part of a golf course. The artificial/simulated grass blades 120 may vary in length or density or materials depending on what a user may want to practice for. The generally spherical central core 110 may include but not limited to, solid rubber, solid synthetic rubber, molded rubber, etc. The simulated/artificial turf 120 may include but not limited to, simulated/artificial Bermuda grass, simulated/artificial perennial ryegrass, simulated/artificial Zoysia, etc. In additional embodiments, a simulated/artificial turf 120 may include different colors to reflect the different seasons of the year. For example, a golf ball may be enclosed, encircled or surrounded with green, yellow, brown, red, or orange simulated/artificial grass blades.

Figure 4A:
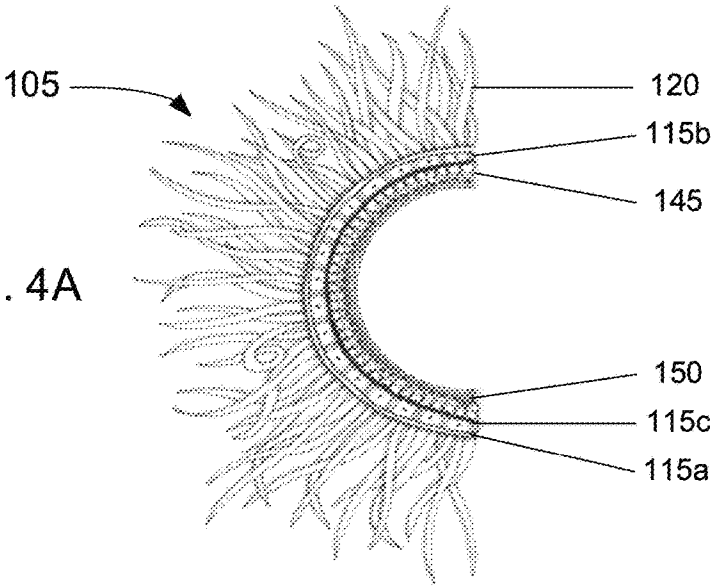
FIG. 4A and FIG. 4B illustrates an exemplary golf ball structure with artificial and/or simulated grass blades 120, in accordance with an embodiment of the invention.
Figure 4B:
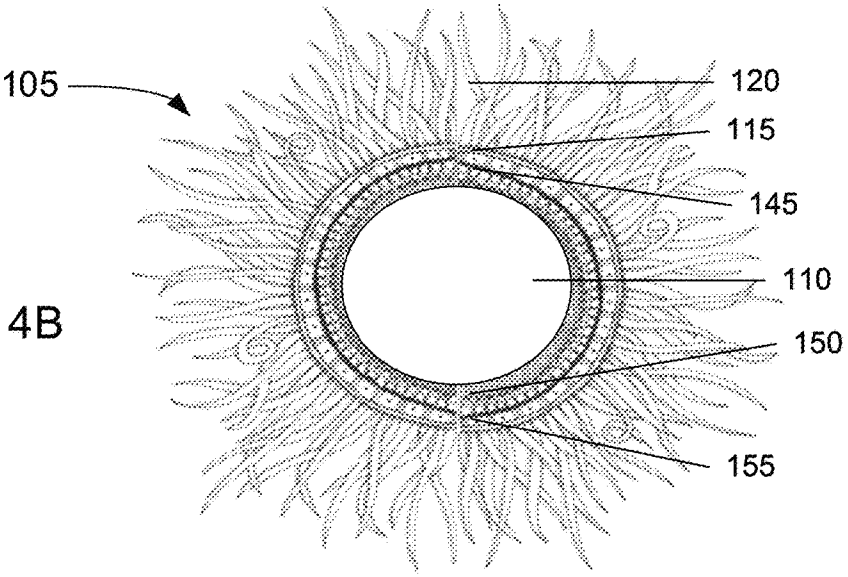

FIG. 4A and FIG. 4B illustrates an exemplary golf ball structure with artificial/simulated grass blades 120, in accordance with an embodiment of the invention. In one embodiment of the present invention, FIG. 4A shows an artificial/simulated grass leaves 120 for partially enclosing a generally spherical central core 110, an outer cover 115 having an outer surface area 115*a*, a mid-section 115*b* and an inner surface area 115*c*, an attachment mechanism 145, and a central core attachment support implement 150. The simulated/artificial grass 120 around the golf ball may comprise but not limited to, simulated/artificial Bermuda grass, simulated/artificial perennial ryegrass, simulated/artificial Zoysia, etc. The attachment mechanism 145 may include but not limited to, sleeve, implants, adhesive, etc. The central core attachment support 150 may include but not limited to, rubber or plastic winding around the central core which may support a speed and/or bounce of the golf ball structure and/or attachment of the outer cover 115 to the central core 110 by providing a rough surface for the outer surface to attach to, etc. By adjusting the winding around the central core, the speed and/or bounce of the golf ball structure may be controlled. The artificial/simulated grass blades 120 may vary in length or density or materials depending on what a user may want to practice for. In additional embodiments, a simulated/artificial grass blades 120 may include different colors to reflect the different seasons of the year. For example, a golf ball may comprise green, yellow, brown, red, or orange simulated/artificial grass blades.

In the embodiment of the present invention, FIG. 4B shows an artificial/simulated grass leaf blades 120 enclosing a generally spherical central core 110, an outer covering 115, an attachment mechanism 145, and a ball/attachment support 150, to produce a practice putting golf ball 105. The outer cover 115 may comprise of two (2) or more parts glued or stitched together to enclose the central core. Alternatively, the outer cover 115 may comprise of a single piece enclosing the central core. Furthermore, a golf ball 105 may be made completely of alternative materials, possibly to mimic conditions besides the green part of a golf course. The artificial/simulated grass blades 120 may vary in length or density or materials depending on what a user may want to practice for. The ball/attachment support 150 may include but not limited to, rubber or plastic winding around the central core to support a speed, bounce, and/or attachment of the outer cover 115 to the central core 110, etc. The central core 110 may include but not limited to, solid rubber, solid synthetic rubber, molded rubber, rubberized material, etc. In additional embodiments, a simulated/artificial grass blades 120 may include different colors to reflect the different seasons of the year. For example, a golf ball may comprise green, yellow, brown, red, or orange simulated/artificial grass blades.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6) (post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post AIA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112(6) (post AIA 112(f)) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant (s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing golf balls according to the present invention will be apparent to those skilled in the art. Various aspects of the invention have been described above by way of illustration, and the specific embodiments disclosed are not intended to limit the invention to the particular forms disclosed. The particular implementation of the golf balls may vary depending upon the particular context or application. By way of example, and not limitation, the golf balls described in the foregoing were principally directed to golf balls for practice implementations; however, similar techniques may instead be applied to soccer balls mimicking grass play, tennis balls mimicking clay play, basketballs mimicking indoor or outdoor concrete play, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A golf ball comprising:

a spherical center core;

an outer layer, wherein said outer layer adhered to and is configured to completely encase said center core, the outer layer comprising an outer surface;

a plurality of simulated grass blades engaged with and extending from said outer layer, said plurality of simulated grass blades completely covering the entire outer surface of the outer layer, wherein said plurality of simulated grass blades are configured to simulate a grass turf, wherein each of the plurality of simulated grass blades has a height dimension of between 3 mm and 6 mm, a width dimension of between 0.2 to 0.6 mm in width, and a thickness dimension of between 0.05 mm and 0.2 mm, and further wherein the thickness dimension is less than the width dimension;

wherein the golf ball has a total diameter of 42.67 mm, including the core, the outer layer and the height dimension of the plurality of grass blades, and wherein the golf ball has a total mass of 45.93 g, and wherein said device is configured to be operable for practicing golf putting strategies or techniques.

2. The golf ball of claim 1, in which said plurality of simulated grass blades comprises artificial Bermuda grass material.

3. The golf ball of claim 1, in which said plurality of simulated grass blades comprises artificial perennial ryegrass material.

4. The golf ball of claim 1, in which said plurality of simulated grass blades comprises artificial Zoysia grass material.

5. The golf ball of claim 1, in which said center core comprises at least a solid rubberized material.

6. The golf ball of claim 1, in which said center core comprises at least a hollow synthetic rubber material.

7. The golf ball of claim 1, in which said center core comprises at least one of, a molded solid rubberized material and a molded solid synthetic rubber material.

8. The golf ball of claim 1, further comprising an attachment mechanism, wherein said attachment mechanism is configured to engage said plurality of simulated grass blades to said outer layer.

9. The golf ball of claim 8, in which said attachment mechanism comprises at least one of, gluing, bonding, and molding of said plurality of simulated grass blades to said outer layer.

10. The golf ball of claim 8, in which said attachment mechanism comprises at least one of, stitching and embedding of said plurality of simulated grass blades to said outer layer.

11. The golf ball of claim 1, in which said plurality of simulated grass blades further comprises a plurality of green colored grass blades that is configured to simulate a spring grass turf.

12. The golf ball of claim 1, further comprising a central core attachment support implement that is configured to adjust a speed or bounce of said device.

13. The golf ball of claim 12, in which said central core attachment support implement comprises a rubber or plastic winding around the central core that is configured to adjust said speed or bounce of said device.

14. The golf ball of claim 1, in which said outer layer comprises at least two or more engaged parts that are configured to enclose said center core.

15. The golf ball of claim 1, in which said outer layer comprises at least a single piece that is configured to enclose said central core.

16. A golf ball that is configured to be operable for practicing golf putting strategies or techniques, said golf ball comprising:

a spherical center core implement;

means for completely encasing said center core implement;

means for simulating a grass turf comprising a plurality of artificial grass blades, wherein each of the plurality of artificial grass blades has a height dimension of between 3 mm and 6 mm, a width dimension of between 0.2 mm and 0.6 mm in width, and a thickness dimension of between 0.05 mm and 0.2 mm, and further wherein the thickness dimension is less than the width dimension;

means for engaging said plurality of artificial grass blades to said encasing means, said plurality of artificial grass blades completely covering an entire surface of said encasing means; and means for supporting said center core implement comprising a rubber or plastic winding around the central core implement that is configured to adjust said speed or bounce of said device, wherein said golf ball has a total diameter of 42.67 mm, including the spherical center core implement, the means for completely encasing the center core implement, and the height dimension of the plurality of artificial grass blades.

17. A golf ball comprising:

a spherical center core implement, in which said center core implement comprises at least one of, a rubber material, a rubberized material, a synthetic rubber material, and a synthetic rubberized material;

an outer layer implement, in which said outer layer implement comprises at least two or more engaged parts that are configured to completely encase said center core implement, the outer layer implement comprising an outer surface;

wherein the spherical center core implement and the outer layer implement form a center portion, wherein the center portion has a diameter from 36 mm to less than 41 mm;

a plurality of simulated grass blades engaged with and completely covering the outer surface of said outer layer implement, wherein each of the plurality of simulated grass blades has a height dimension of between 3 mm and 6 mm, a width dimension of between 0.2 to 0.6 mm in width, and a thickness dimension of between 0.05 mm and 0.2 mm, and further wherein the thickness dimension is less than the width dimension;

in which said plurality of simulated grass blades comprises at least one of, an artificial Bermuda grass material, an artificial perennial ryegrass material, and an artificial Zoysia grass material;

an attachment mechanism, wherein said attachment mechanism is configured to engage said plurality of simulated grass blades to said outer layer implement, in which said attachment mechanism comprises at least one of, stitching, gluing, bonding and embedding of said plurality of simulated grass blades to said outer layer;

wherein said golf ball has a total diameter of 42.67 mm, including the spherical center core implement, the outer layer implement, and the height dimension of the plurality of simulated grass blades, and wherein said golf ball is configured to be operable for practicing golf putting strategies or techniques.

18. The golf ball of claim 17, further comprising a central core attachment support implement that is configured to adjust a speed or bounce of said golf ball, in which said center core implement attachment support implement comprises at least a rubber or plastic winding around said central core implement that is configured to adjust said speed or bounce of said golf ball.

19. The golf ball of claim 1, wherein the spherical center core and the outer layer form a center portion, wherein the center portion has a diameter from 36 mm to less than 41 mm.

20. The golf ball of claim 16 wherein the spherical center core implement and the outer layer form a center portion, wherein the center portion has a diameter from 36 mm to less than 41 mm.

21. The golf ball of claim 16, wherein the golf ball has a mass of 45.93 g.

22. The golf ball of claim 17, wherein the golf ball has a mass of 45.93 g.

* * * * *